US005927023A

United States Patent [19]

Kittilstad

[11] Patent Number: 5,927,023

[45] Date of Patent: Jul. 27, 1999

[54] ROOF EDGE FASCIA SYSTEM FOR SECURING A MEMBRANE IN PLACE

[75] Inventor: Scott Kittilstad, Waukesha, Wis.

[73] Assignee: Metal-Era, Inc., Waukesha, Wis.

[21] Appl. No.: 08/999,575

[22] Filed: Nov. 25, 1997

Related U.S. Application Data

[60] Provisional application No. 60/031,832, Nov. 26, 1996.

[51] Int. Cl.[6] ..... E04D 1/36

[52] U.S. Cl. ..... 52/60; 52/96; 52/716.2; 52/741.4

[58] Field of Search ..... 52/58, 60, 94, 52/96, 97, 467, 716.2, 717.06, 718.02, 718.03, 718.04, 718.05, 718.06, 741.4, 746.11, 748.1, 748.11

[56] References Cited

U.S. PATENT DOCUMENTS

| | | | |
|---|---|---|---|
| 2,168,204 | 8/1939 | Hanson | 52/60 |
| 2,646,011 | 7/1953 | Ager . | |
| 3,365,847 | 1/1968 | Joseks . | |
| 3,389,515 | 6/1968 | Hellebrand . | |
| 3,404,495 | 10/1968 | Simpson, Jr. . | |
| 3,432,976 | 3/1969 | Berg . | |
| 3,444,658 | 5/1969 | Gobel . | |
| 3,507,470 | 4/1970 | Gobel . | |
| 3,624,973 | 12/1971 | Attaway | 52/60 |
| 3,680,269 | 8/1972 | Fischer, Jr. et al. . | |
| 3,774,364 | 11/1973 | Johnson . | |
| 3,815,302 | 6/1974 | Monroe . | |
| 3,862,531 | 1/1975 | Attaway . | |
| 4,037,372 | 7/1977 | Patry . | |
| 4,071,987 | 2/1978 | Hickman . | |
| 4,083,158 | 4/1978 | Wolma . | |
| 4,419,850 | 12/1983 | Butzen . | |
| 4,472,913 | 9/1984 | Hickman . | |
| 4,483,112 | 11/1984 | Rueblinger . | |
| 4,519,172 | 5/1985 | Ristow . | |
| 4,549,376 | 10/1985 | Hickman . | |
| 4,574,544 | 3/1986 | Harris, Sr. . | |
| 4,641,476 | 2/1987 | Webb et al. . | |
| 4,648,218 | 3/1987 | Butzen . | |
| 4,662,129 | 5/1987 | Hickman | 52/60 X |
| 4,665,667 | 5/1987 | Taylor et al. . | |
| 4,707,954 | 11/1987 | Butson . | |
| 4,759,157 | 7/1988 | Webb et al. | 52/60 |
| 4,780,997 | 11/1988 | Taylor et al. . | |
| 4,780,999 | 11/1988 | Webb et al. | 52/60 X |
| 4,800,689 | 1/1989 | Lane . | |
| 4,858,406 | 8/1989 | Lane et al. . | |
| 5,189,853 | 3/1993 | Braine et al. | 52/96 |

FOREIGN PATENT DOCUMENTS

| | | | |
|---|---|---|---|
| 2041160 | 2/1972 | Germany | 52/96 |

*Primary Examiner*—Carl D. Friedman
*Assistant Examiner*—Laura A. Callo
*Attorney, Agent, or Firm*—Nilles & Nilles, S.C.

[57] ABSTRACT

A fascia assembly for securing a rubber membrane against the surface of a roof, the fascia comprising a rigid base plate including a generally planar vertical portion adapted to be secured to the generally vertical edge portion of the roof and to clampingly engage a portion of the rubber membrane to secure the rubber membrane against the vertical edge portion of the roof, and including a generally planar horizontal portion adapted to engage a portion of the membrane supported by the upper surface of the roof adjacent the edge and to secure the membrane against the upper surface of the roof. The fascia assembly further includes a cover plate for providing a decorative cover over the base plate, and a spring clip for supporting the cover plate relative to the base plate. The base plate, cover plate and spring clip being fabricated from bended sheet metal blanks.

2 Claims, 3 Drawing Sheets

ROOF EDGE FASCIA SYSTEM FOR SECURING A MEMBRANE IN PLACE

RELATED APPLICATION

The present application claims the benefit of U.S. Provisional Application Ser. No. 60/031,832 filed on Nov. 26, 1996, under the same title and inventor.

BACKGROUND OF THE INVENTION

1. Field of the Invention

The present invention relates to a fascia system for use in securing a rubber roof membrane to the edge of a roof.

2. Background of the Prior Art

Large rubber membranes are commonly used for covering a roof such as a flat roof. The membrane is laid over the surface of the roof and secured in place by adhesive or mechanical fastening means. A number of prior art mechanisms have also been developed for securing the edges of a rubber roof membrane in place to the edge of the roof.

In some applications the rubber membrane may be subjected to large wind forces causing the rubber membrane to tend to pull away from the surface of the roof. The edge of the roof is especially susceptible to damage from wind shear forces, and, if the edge of a rubber roof membrane were to become detached from the roof, all or a substantial portion of the membrane may be blown off. For this reason, it is necessary to provide a means for rigidly securing the edge of the rubber membrane in place to prevent the edge of the membrane from pulling away from the edge of the roof.

An example of a fascia system for securing the edge of a roofing membrane is disclosed in U.S. Pat. Nos. 4,665,667 and 4,780,997. The particular fascia system disclosed in those patents, however, is comprised of an extruded aluminum profile which is used as a base plate to secure the membrane to the edge of the roof. While an extruded profile is rigid and quite effective in securing the membrane in place, an extruded profile has certain significant costs associated its production, e.g. the cost of the mold and other items. Therefore, a less costly but equally effective roof edge fascia system is desired.

SUMMARY OF THE INVENTION

The present invention provides an improved fascia system for securing the periphery of a rubber membrane to the edge of a roof so that the rubber membrane is firmly clamped in place against the surface of the roof and will not pull up as a result of wind forces on the membrane.

More particularly, the present invention is a fascia comprised of a rigid generally L-shaped base-plate adapted to be secured to the vertical surface of the edge of the roof. The rigid L-shaped plate has a generally planar vertical portion for engaging an edge portion of the rubber membrane extending downwardly from the corner of the roof and for clamping the edge of the membrane against the vertical surface at the edge of the roof. The fascia also includes a generally horizontal planar portion extending rearwardly from the vertical portion of the rigid L-shaped plate for clamping that portion of the rubber membrane adjacent the edge of the roof down against the upper surface of the roof.

Means are also provided for securing the fascia to the vertical surface of the wall such that the vertical portion of the fascia clamps the edge of the rubber membrane against the wall and such that the horizontal portion engages the rubber membrane and forces it down against the surface of the roof to hold it in place. In one preferred embodiment of the invention, the means for securing the fascia to the vertical surface of the wall includes a plurality of screws extending through apertures provided in the vertical portion and into the vertical surface of the wall at a location directly below the upper surface of the roof.

In a preferred form of the invention, the fascia also includes means for supporting a cover plate such that the cover plate can snap onto the face of the fascia and be resiliently held against the fascia. This means can include a first flange extending downwardly and forwardly from the lower end of the vertical portion of the fascia and a second flange extending upwardly and rearwardly from the end of the horizontal portion of the L-shaped base plate. The flanges extend away from the corner edge of the roof and diverge with respect to one another.

The cover plate likewise comprises a generally L-shaped member which also consists of a generally vertical portion and a generally horizontal portion. The cover plate further comprises a first flange which extends upwardly and inwardly from the lower end of the vertical portion of the cover plate, and comprises a second flange which extends downwardly and inwardly from the end of the horizontal portion of the cover plate. Further, the cover plate is sized so that the first flange on the cover plate hooks snugly around the first flange on the base plate and so that the second flange on the cover plate hooks snugly around the second flange on the base plate, respectively.

The fascia system presented herein further comprises a spring clip for supporting an upper corner of the cover plate. The spring clip comprises a hook portion which hooks over the second upwardly and rearwardly projecting flange on the base plate, and the spring clip comprises a central portion which extends in an angled direction away from the base plate toward the inside corner of the L-shaped cover plate. The spring clip biases the inside corner of the cover plate upwardly and outwardly away from the outside corner of the base plate, which in turn causes the first and second flanges of the cover plate to snap snugly in place over the first and second flanges of the base plate, respectively.

The fascia system presented herein has the advantage that it may be fabricated entirely from bent sheet metal, as opposed to extruded metal profiles. The unique structure of the fascia system presented herein is just as rigid and durable as extruded fascia systems, but can be fabricated at less cost, thereby providing a significant cost advantage over prior art systems.

Other objects and advantages of the invention will become apparent from the following description, which taken in conjunction with the accompanying drawings, set forth by way of illustration and example certain preferred embodiments of this invention.

BRIEF DESCRIPTION OF THE DRAWINGS

The drawings, which constitute a part of this specification and depict an exemplary embodiment of the present invention, include the following.

DESCRIPTION OF THE PREFERRED EMBODIMENTS

Figure 1:
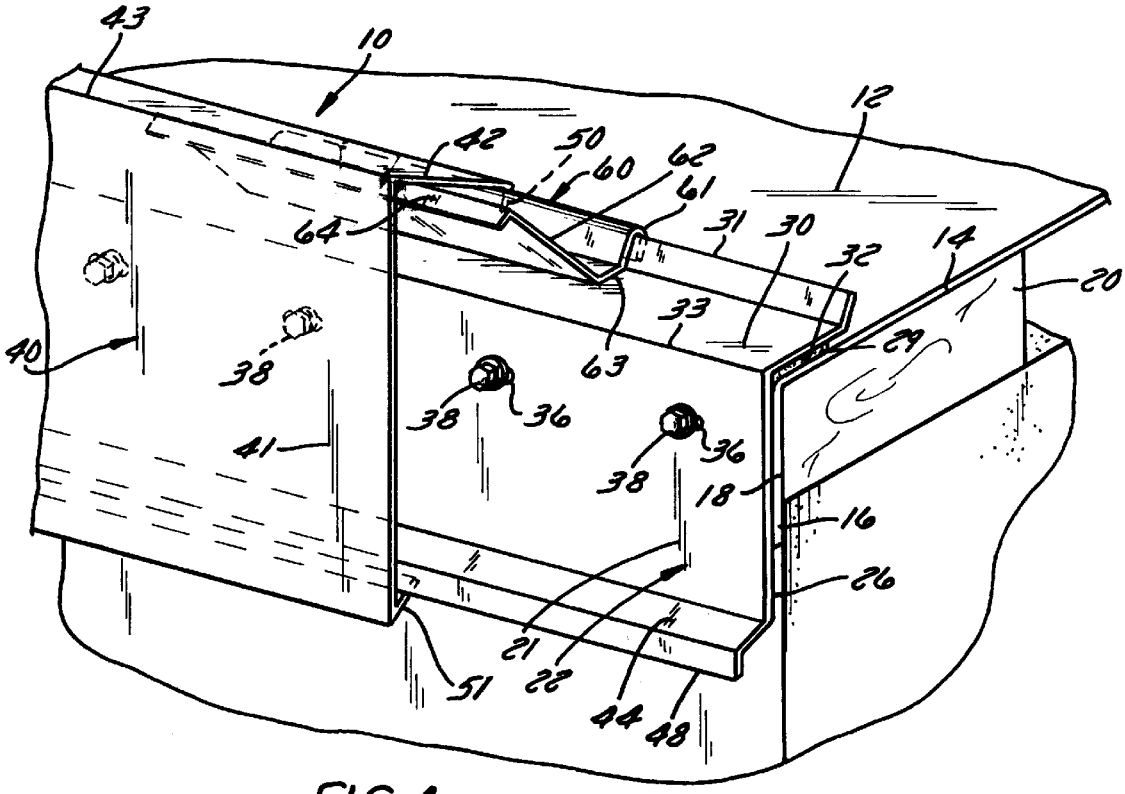
FIG. 1 is a perspective view of the fascia assembly embodying the present invention and with portions cut away, the fascia assembly being illustrated as clamping the rubber membrane against a roof surface.
Figure 5:
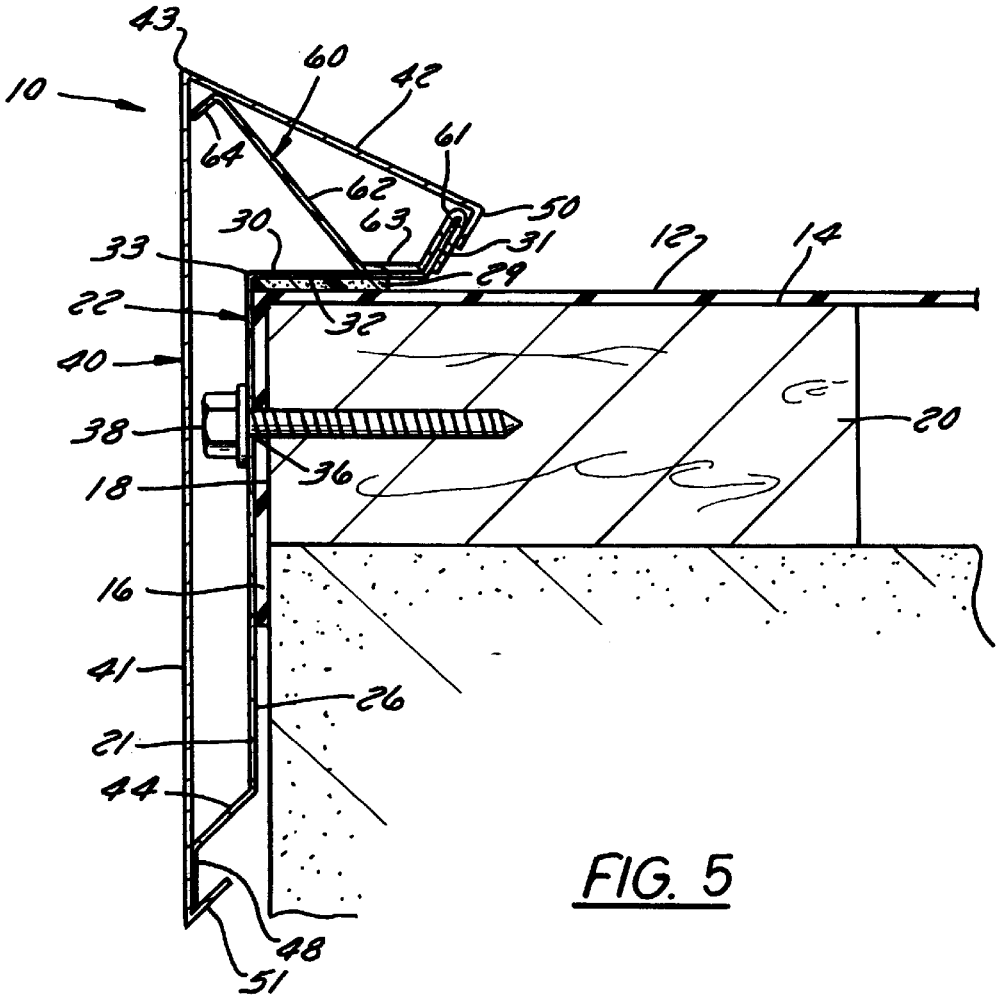
FIG. 5 is a cross-section view of a preferred embodiment of the roof edge fascia.
Figure 4:
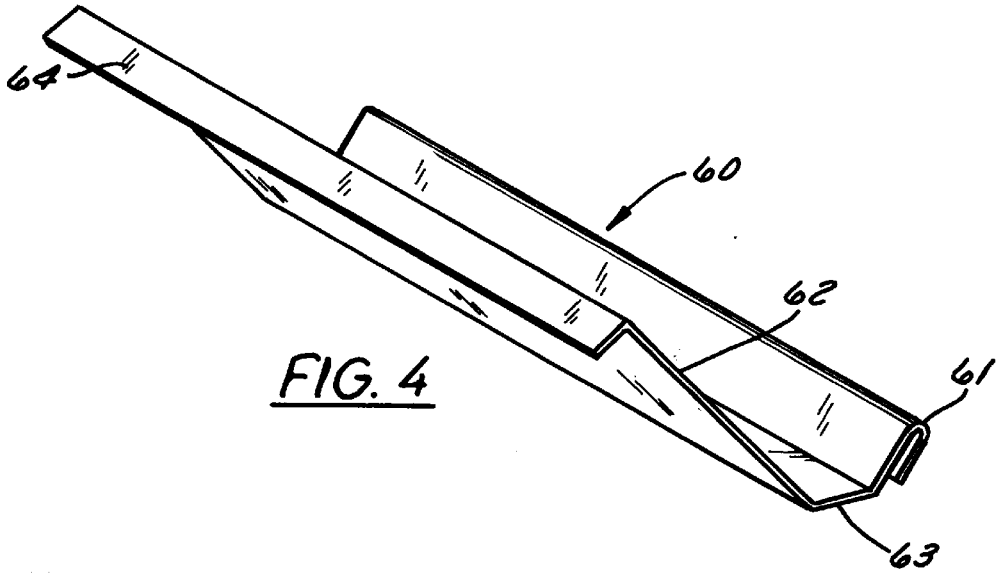
FIG. 4 is a perspective view of the spring clip for supporting the cover plate for the roof edge fascia disclosed herein.

Illustrated in FIGS. 1 and 5 is a fascia assembly 10 adapted to secure the edge of a rubber membrane 12 to the surface 14 of a flat roof. The rubber membrane 12 is supported by the flat generally horizontal upper surface 14 of a roof. The edge portion 16 of the membrane 12 extends over the vertical face 18 of a conventional wooden nailer 20 such that the edge portion 16 of the membrane 12 can be secured against the vertical face 18 of the nailer 20.

The fascia assembly 10 includes an elongated rigid fascia 22 adapted to extend along the corner edge of the roof and to secure the rubber membrane 12 to the nailer 20 to thereby prevent the edge of the rubber membrane 12 from pulling upwardly away from the edge of the roof. The fascia 22 comprises a rigid generally L-shaped base-plate which includes a generally planar vertical portion 21 for presenting a planar rearward surface 26 adapted for engagement against the edge portion 16 of the rubber membrane 12 which is folded over the edge of the roof and for clamping that portion 16 of the membrane 12 securely against the vertical face or surface 18 of the nailer 20.

The fascia also includes a generally planar horizontal portion 30 extending rearwardly from the upper end of the vertical portion 21, the rearwardly extending horizontal portion 30 including a lower surface 32 adapted to engage the rubber membrane 12 and to secure it downwardly against the upper surface 14 of the nailer 20 such that the rubber membrane cannot be pulled away from the surface of the roof or away from the edge of the roof.

In a preferred form of the invention the rearwardly extending horizontal portion 30 will also include an edge portion 31 extending along its length, the edge portion 31 being inclined upwardly and rearwardly from the end of the horizontal portion 30. At the lower edge of the vertical portion 21 of the fascia 22 is a second edge portion 44 which is similarly inclined downwardly and forwardly and which terminates in a downwardly extending lip 48.

Means are also provided for securing the fascia 22 to the edge of the roof such that the edge portion 16 of the membrane 12 extending over the edge of the roof will be clamped in place between the rearward planar surface 26 of the vertical portion 21 of the fascia 22 and the vertical face 18 of the nailer 20 forming the edge of the roof. The means for securing the fascia 22 in place also causes the horizontal portion 30 of the fascia to secure a portion of the upper surface of the membrane 12 down against the upper surface of the roof.

While the means for clamping could have various constructions, in the illustrated arrangement a plurality of apertures or slots 36 are provided through the vertical plate portion 24. The apertures 36 are spaced apart along the length of the fascia 22, and screws or bolts 38 can extend through the apertures 36 to rigidly secure the fascia 22 to the wooden nailer 20 forming the edge portion of the roof.

When the fascia 22 is in place, as illustrated in FIG. 5, the fascia assembly 10 provides a very rigid and secure mechanism for clamping the edge of the rubber membrane against the surface of the roof and provides a firm means for securing the rubber membrane in place and is resistant to even large upward forces on the membrane which might be caused by high winds. For additional protection against moisture seeping from the roof, a multi-purpose sealant 29 may be optionally placed between the upper surface of the membrane 12 and the lower surface 32 of the rearwardly extending horizontal portion 30 of the fascia 22.

The preferred embodiment of the fascia 22 disclosed above is especially well suited for fabrication from bended sheets of steel, aluminum or other suitable metal or metal allow. A method of fabricating the fascia consequently includes selecting a sheet metal blank of suitable dimensions and material (e.g., 4-inch by 12-foot blank of 0.050-inch mill aluminum) and forming a series of apertures 36 spaced along the length of the sheet blank. The method of fabrication further comprises bending a first portion of the sheet blank approximately 90° relative to a second portion of the sheet blank such that the first portion forms the generally vertical planar portion 21 of the fascia and the second portion forms the rearwardly extending horizontal portion 30 of the fascia. Further, a third portion of the sheet blank is bent approximately 60° relative to the second portion, the third portion thereby forming the upwardly and rearwardly extending edge portion 31 of the fascia. A fourth portion of the sheet blank is bent approximately 45° relative to the first portion, the fourth portion thereby forming the downwardly and forwardly extending flange 44 of the fascia. A fifth portion of the sheet blank is bent approximately 45° relative to the fourth portion, the fifth portion thereby forming the downwardly extending lip 48 of the fascia.

The fascia assembly also includes a cover plate 40 which is adapted to be positioned over the fascia 22 and to provide a decorative cover for the fascia 22 and the screws 38 used to secure the fascia to the edge of the roof. The fascia cover plate 40 includes a generally vertical front portion 41 which covers over the front surface of the vertical portion 21 of the fascia 22 and an upper portion 42 which covers over the top surface of the horizontal portion 30 of the fascia. The cover plate 40 also includes an upper edge defining a lip 50 adapted to hook over and engage the upper edge of the upwardly and rearwardly extending flange portion 31 of the fascia 22. The cover plate 40 also includes a lower edge defining a lower lip 51 adapted to hook under and engage the lower edge lip 48 of the fascia. The lower lip 51 of the cover plate 40 is further adapted to be resiliently forced under the lower edge of the lip 48 of the fascia 22. Once the upper lip 50 of the cover plate 40 has been hooked over the edge of the upper flange 31, the lower lip of the cover 51 can be forced under the lower lip 48 of the fascia 22 to resiliently hold the cover plate 40 in place. The cover plate 40 is adapted to fit snugly over the fascia 22 so that, after it is snapped into place, it cannot be inadvertently removed by wind. A spring clip 60 (discussed further below) attached to the fascia 22 supports the upper corner 43 of the cover plate 40.

The cover plate is likewise especially well suited for fabrication from bended sheets of steel, aluminum or other suitable metallic materials. To differentiate it from the fascia 22, the sheet steel used for fabricating the cover plate 40 will be designated as a second sheet metal blank, and the relevant portions of the material will be designated as a sixth portion, seventh portion, and so on. Thus, a method of fabricating the cover plate 40 preferably comprises selecting a second sheet metal blank of suitable dimensions and material (e.g., 6-⅜-inch by 12-foot blank of 24-gauge steel or alternatively 0.040-inch aluminum) and providing on at least one side of the sheet a decorative color finish. The method of fabricating the cover plate further comprises bending a sixth portion of the sheet blank approximately 115° relative to a seventh portion such that the sixth portion forms the vertical front portion 41 of the cover plate 40 and the seventh portion forms the upper portion 42 of the cover plate 40. Further, an eighth portion of the sheet blank is bent approximately 80° relative to the seventh portion, the eighth portion thereby forming the upper lip 50 of the cover plate which hooks over the upper edge 31 of the fascia 22. A ninth portion of the sheet blank is bent approximately 135° relative to the sixth portion, the ninth portion thereby forming the lower lip 51 of the cover plate 40 which hooks underneath the lower edge 48 of the fascia 22.

The fascia system presented herein further comprises a spring clip 60 for supporting the upper corner 43 of the cover plate 40. The spring clip 60 comprises a hook portion 61 which hooks over the upwardly and rearwardly projecting flange 31 on the fascia 22, and the spring clip 60 comprises a central portion 62 which extends in an angled direction away from the fascia 20 toward the inside corner 43 of the L-shaped cover plate. The spring clip 60 biases the inside corner 43 of the cover plate 40 upwardly and outwardly away from the outside corner 33 of the fascia 27, which in turn causes the upper lip 50 and lower lip 51 of the cover plate 40 to snap snugly in place over the upper flange 31 and lower flange 48 of the fascia 22, respectively.

The spring clip 60 is similarly well suited for fabrication from bended metal sheet blanks. Again, to differentiate the spring clip 60 from the fascia 22 and cover plate 40, the sheet steel used for fabricating the spring clip 60 will be designated as a third sheet metal blank, and the relevant portions of the material will be designated as a tenth portion, eleventh portion, and so on. Thus, the method of fabricating the spring clip 60 preferably comprises selecting a third sheet metal blank of suitable dimensions and material (e.g., 3-inch by 6-inch blank of stainless spring steel). The method of fabricating the spring clip 60 further comprises bending a tenth portion of the material approximately 180° relative to an eleventh portion so that the tenth portion is folded over the eleventh portion with a small gap (e.g., approximately 1/16th inch) between the tenth and eleventh portions to thereby form the hook portion 61 of the spring clip which fits over the upper flange 31 of the fascia 22. Further, a twelfth portion of the steel blank is bent approximately 65° relative to the eleventh portion, the twelfth portion thereby defining a small part 63 of the spring clip which rests on top of the upper surface of the rearwardly extending horizontal portion 30 of the fascia 22. A thirteenth portion of the steel blank is bent approximately 56° relative to the twelfth portion, the thirteenth portion thereby forming the central portion 62 of the spring clip 60 which extends in an angled direction away from the fascia 22 and toward the inside corner 43 of the cover plate 40. A fourteenth portion of the steel blank is bent approximately 115° relative to the thirteenth portion, the fourteenth portion 64 being the portion which directly abuts against and supports the inside corner 43 of the cover plate 40 as shown in FIG. 5.

Figure 2:
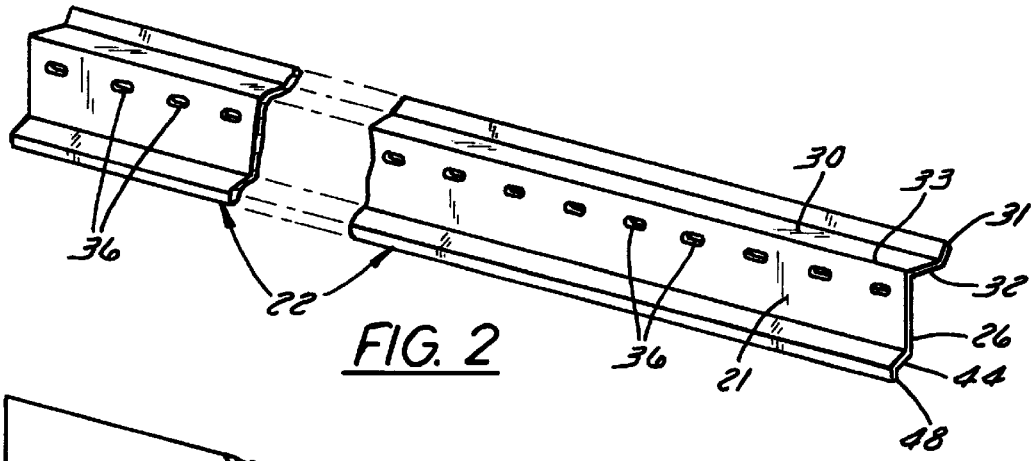
FIG. 2 is a perspective view of the rigid generally L-shaped base-plate for securing a rubber roof membrane to the edge of a roof in accordance with the present invention.
Figure 3:
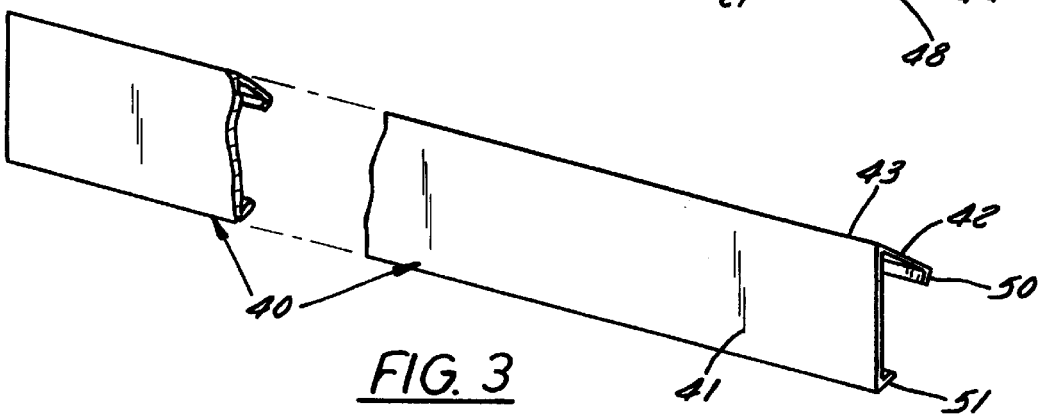
FIG. 3 is a perspective view of the cover plate for the roof edge fascia disclosed herein.
Figure 6:
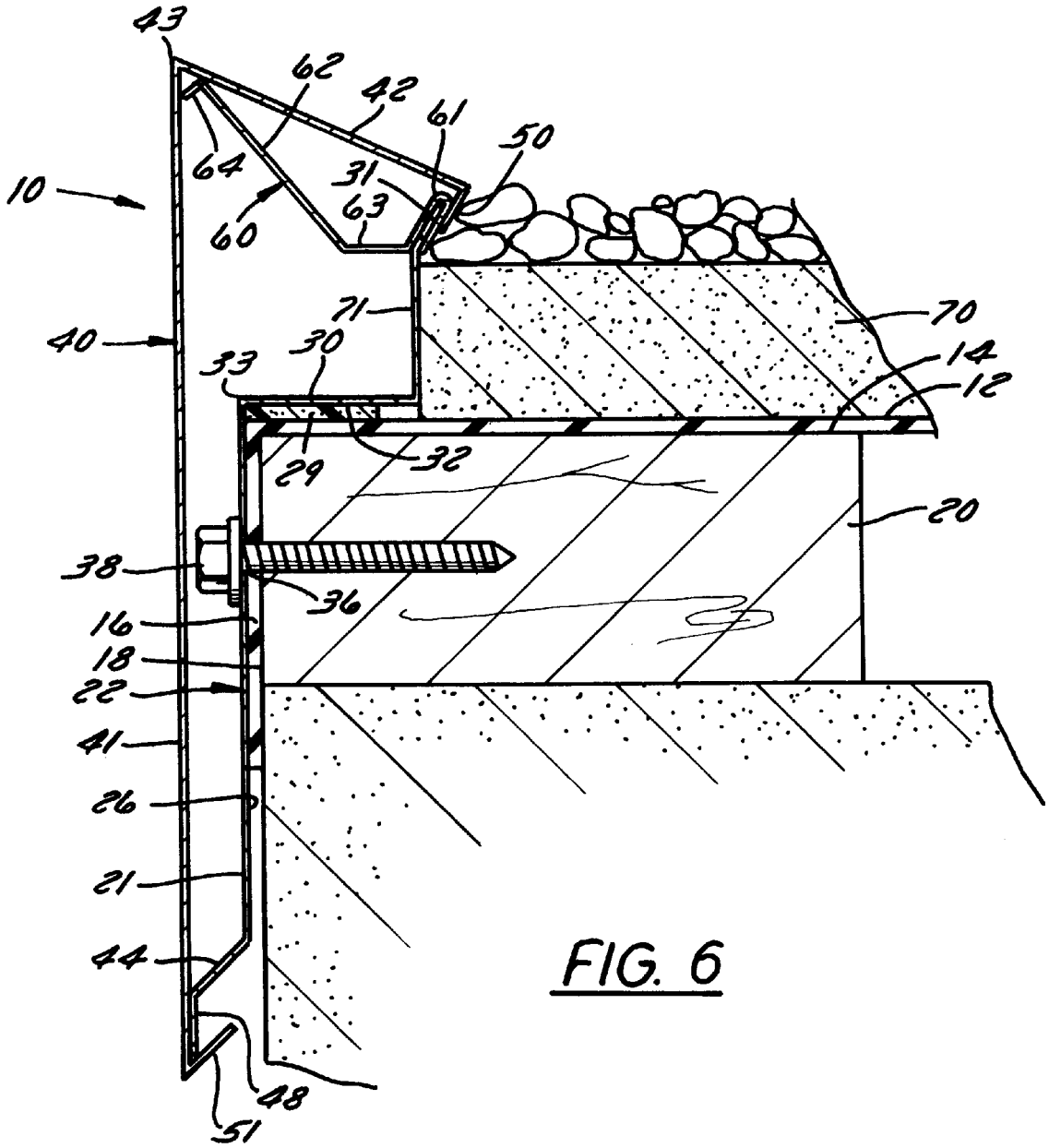
FIG. 6 is a cross-section view of a second embodiment of the roof edge fascia.

Illustrated in FIG. 6 is an alternative embodiment of the fascia assembly embodying the invention. The fascia assembly shown in FIG. 6 is similar in construction to that shown in FIGS. 1, 2 and 5 with common elements numbered as in FIGS. 1, 2 and 5, but further includes means for retaining an edge of a paver block 70 placed the surface of the roof. In the construction shown in FIG. 6 a plurality of paver blocks 70 are provided as weights for holding the rubber membrane 12 down against the surface 14 of the roof. Conventional paver blocks 70 typically have a thickness of about 1-½ to 2 inches. The paver blocks 70 are placed together in edge to edge abutting relation to cover at least a substantial portion of the rubber membrane 12.

In the arrangement shown in FIG. 6, the fascia assembly includes a rearwardly extending horizontal portion 30 adapted to overlie the membrane at the edge of the roof and to secure the membrane down against the surface of the roof. The fascia assembly also includes a vertical portion 21 adapted to be positioned against the edge 16 of the membrane hanging over the edge of the roof for securing that edge portion of the membrane against the edge of the roof. The fascia further includes a second vertical portion 71 extending upward from the rearward end of the horizontal portion 30, the second upward extending vertical portion 71 effectively forming a wall for retaining the paver block 70 on the roof.

Additional paver blocks 70 can then be placed on the membrane 12 in abutting relation with the outer peripheral row of paver blocks 70 to provide additional weight on the membrane 12.

Although the fascia assembly disclosed herein has been described with specific reference to certain dimensional parameters, such parameters may be changed or modified depending upon the nature of the construction. Therefore, specific structural details disclosed above are not intended to limit the scope of the invention, but merely for a basis for the claims and for teaching one skilled in the art to variously employ the present invention in any appropriately detailed manner. Changes may be made in the details of the structure or material from which the invention is made without departing from the spirit of the invention, especially as defined in the following claims.

I claim:

1. A roof fascia assembly for securing a membrane to a roof, said roof having a substantially flat horizontal upper surface and a downwardly extending vertical surface, the horizontal upper surface and the vertical surface intersecting each other to define a corner edge of the roof, said membrane being comprised of a substantially rubber sheet material having a first portion supported by the upper surface of the roof and a second portion of the membrane extending downwardly from the corner edge and being adjacent to the vertical surface of said roof, said roof fascia assembly comprising:

an elongated, rigid aluminum fascia base plate adapted to be secured to the downwardly extending vertical surface of the roof and adapted to clamp the membrane against the horizontal upper surface of the roof and against the downwardly extending vertical surface of the roof, said rigid aluminum fascia base plate including a generally horizontal planar portion and a generally vertical planar portion, said horizontal planar portion including a lower planar surface adapted for engaging the first portion of the membrane supported by the horizontal upper surface of the roof and adapted for holding the second portion of the membrane down against the upper surface of the roof;

said generally vertical planar portion having a generally planar rearward surface adapted to be positioned in facing relation with respect to the downwardly extending vertical surface of the roof and adapted to secure the second portion of the membrane against the vertical surface of the roof;

the rigid aluminum fascia base plate being characterized by the generally horizontal planar portion extending rearwardly from an upper end of the vertical planar portion so that the upper end of the vertical planar portion and the horizontal planar portion of the fascia base plate define a corner section adapted to fit snugly against the corner edge of the roof, said fascia base plate further including an upper flange extending upwardly and rearwardly from a rearward end of the horizontal planar portion, and said fascia base plate further including a lower flange extending downwardly and forwardly from a lower end of vertical planar portion;

said fascia base plate further including a series of spaced apart slots oriented lengthwise along the length of the vertical planar portion of the fascia base plate and said roof fascia assembly including a set of screws adapted to extend through the slots for securing the fascia base plate to the downwardly extending vertical surface of the roof;

the roof fascia assembly further including a cover plate for covering said rigid fascia, said cover plate including a generally vertical front portion for covering over the vertical planar portion of the fascia base plate and a rearwardly extending upper portion for covering over the horizontal planar portion of the fascia base plate, said front portion and upper portion being joined at a corner, said cover plate further including an upper lip adapted to be hooked over and engage said upper flange of said fascia base plate and further including a lower lip adapted to hook under and engage said lower flange of said fascia base plate, a spring clip for supporting the corner of the cover plate, said spring clip comprising a hook portion adapted to hook over the upwardly and rearwardly extending upper flange on the fascia base plate, and including a central portion which extends in an angled direction upwardly and forwardly away from the corner section of the fascia base plate and toward the inside corner of the cover plate;

a layer of sealant adapted for placement between an underside of the rearwardly extending horizontal planar portion of the fascia base plate and the first portion of the membrane being supported by the horizontal upper surface of the roof, said vertical planar portion, horizontal planar portion, upper flange and lower flange of said rigid fascia base plate being comprised of a single piece of bended aluminum sheet metal, and, said front portion, upper portion, upper lip and lower lip of said cover plate being comprised of a second piece of bended sheet metal; and the hook portion and central portion of said spring clip being comprised of a third piece of bended sheet metal.

2. A method of fabricating a roof fascia assembly for securing a roofing membrane to a roof, said roof having a substantially flat horizontal upper surface and a downwardly extending vertical surface, the horizontal upper surface and vertical surface intersecting at a corner edge, said membrane being comprised of a substantially rubber sheet material having a first portion supported by the horizontal upper surface of the roof and a second portion of the membrane extending downwardly from the corner edge and being adjacent to the vertical surface of the roof, said method comprising:

selecting a first elongated sheet metal blank for fabricating a rigid fascia base plate, said first sheet blank being comprised of aluminum, said first sheet blank being further comprised of a first portion, a second portion, a third portion, a fourth portion and a fifth portion, the steps for fabricating said rigid fascia comprising:

forming a series of slots oriented lengthwise and spaced along the length of the first portion of the sheet blank;

bending the first portion of the sheet blank approximately 90° relative to the second portion of the sheet blank such that the first portion forms a generally planar vertical portion of the fascia base plate and the second portion forms a generally planar horizontal portion of the fascia base plate which extends rearwardly from an upper end of the vertical portion, the vertical portion and horizontal portion defining a corner section of the fascia base plate that is adapted to fit snugly over the corner edge of the roof;

bending the third portion of the sheet blank approximately 60° relative to the second portion, the third portion thereby forming an upper flange which extends upwardly and rearwardly from the end of the rearwardly extending horizontal portion of the fascia base plate;

bending the fourth portion of the sheet blank approximately 45° relative to the first portion, the fourth portion thereby forming a lower flange which extends downwardly and forwardly from the lower end of the vertical portion of the fascia base plate;

bending the fifth portion of the sheet blank approximately 45° relative to the fourth portion, the fourth portion thereby forming a lip extending downwardly from the end of the lower flange of the fascia base plate;

selecting a second elongated sheet metal blank for fabricating a cover plate for said fascia base plate, said second sheet blank comprising a sixth portion, a seventh portion, an eighth portion and a ninth portion, the steps of fabricating said cover plate comprising:

providing on at least one side of said second sheet metal blank a decorative color finish;

bending the sixth portion of the second sheet blank approximately 115° relative to the seventh portion such that the sixth portion forms a vertical front portion of the cover plate and the seventh portion forms an upper portion of the cover plate, the front portion and upper portion of the cover plate being joined at a corner;

bending the eighth portion of the second sheet blank approximately 80° relative to the seventh portion, the eighth portion thereby forming an upper lip of the cover plate which is adapted to hook over and engage the upper flange of the fascia base plate;

bending the ninth portion of the sheet blank approximately 135° relative the sixth portion, the ninth portion thereby forming a lower lip of the cover plate which is adapted to hook underneath and engage the lower flange of the fascia base plate;

selecting a third sheet metal blank for fabricating a spring clip, said third sheet metal blank being comprised of a spring steel, said third sheet metal blank further comprising a tenth portion, an eleventh portion, a twelfth portion, a thirteenth portion and a fourteenth portion, the steps of fabricating the spring clip comprising:

bending the tenth portion of the third sheet metal blank approximately 180° relative to the eleventh portion so that the tenth portion is folded over the eleventh portion, and further providing a small gap between the tenth and eleventh portions to thereby form a hook portion on the spring clip which is adapted to fit over the upper flange of the fascia base plate;

bending the twelfth portion of the sheet blank approximately 65° relative to the eleventh portion, the twelfth portion thereby defining a surface which rests on top of the rearwardly extending horizontal portion of the fascia base plate;

bending the thirteenth portion of the sheet blank approximately 50° relative to the twelfth portion, the thirteenth portion thereby forming a central portion of the spring clip which extends in an angled direction away from the fascia and toward an inside corner of the cover plate;

bending the fourteenth portion of the sheet blank approximately 115° relative to the thirteenth portion, the fourteenth portion thereby forming an abutment which biases the inside corner of the cover plate in an upward and outward direction relative to the fascia base plate;

providing a number of screws corresponding to the slots in the fascia base plate, said screws being adapted to extend through said slots and into the vertical surface of the roof for fastening said fascia base plate thereto; and providing a sealant for sealing an underside of generally planar horizontal portion of the fascia base plate to the first portion of the roofing membrane being supported by the upper surface of the roof.

* * * * *